United States Patent [19]

Suzuki et al.

[11] Patent Number: 4,868,958

[45] Date of Patent: Sep. 26, 1989

[54] BACKING DRUM

[75] Inventors: Migaku Suzuki, Kawanoe; Satoshi Nozaki, Ehime; Shigeo Imai; Makoto Ishigami, both of Kawanoe, all of Japan

[73] Assignee: Uni-Charm Corporation, Ehime, Japan

[21] Appl. No.: 219,000

[22] Filed: Jul. 14, 1988

Related U.S. Application Data

[63] Continuation of Ser. No. 932,322, Nov. 19, 1986, abandoned.

[30] Foreign Application Priority Data

Nov. 20, 1985 [JP] Japan ..... 60-260625

[51] Int. Cl.[4] ..... D04H 18/00

[52] U.S. Cl. ..... 28/104; 29/121.3

[58] Field of Search ..... 28/104, 105, 106; 29/121.3

[56] References Cited

U.S. PATENT DOCUMENTS

| | | | |
|---|---|---|---|
| 473,180 | 4/1892 | Richardson et al. | 29/121.3 |
| 3,434,188 | 3/1969 | Summers | 28/104 |
| 3,449,809 | 6/1969 | Shin | 28/104 |
| 3,485,708 | 12/1969 | Ballou et al. | 28/105 X |
| 3,485,709 | 12/1969 | Evans et al. | 28/105 X |
| 3,616,175 | 10/1971 | Jung | 28/105 X |
| 3,873,255 | 3/1975 | Kalwaites | 28/104 |
| 4,083,090 | 4/1978 | Duvekot | 28/104 |
| 4,109,353 | 8/1978 | Mitchell et al. | 28/104 |
| 4,172,172 | 10/1979 | Suzuki et al. | 28/104 X |
| 4,665,597 | 5/1987 | Suzuki et al. | 28/104 |
| 4,718,152 | 1/1988 | Suzuki et al. | 28/104 |

FOREIGN PATENT DOCUMENTS

| | | | |
|---|---|---|---|
| 51-82071 | 7/1976 | Japan | 28/105 |

*Primary Examiner*—Robert R. Mackey

*Attorney, Agent, or Firm*—Fred Philpitt

[57] ABSTRACT

Process and apparatus for producing apertured or non-apertured nonwoven fabric wherein fibrous web is introduced onto support means and treated with high velocity water streams jetted from above. The non-apertured nonwoven fabric may be produced by fiber entangling treatment on a smooth surfaced plate including a plurality of drainage holes as first support means or by further fiber entangling treatment performed on water impermeable second support means after the fiber entangling treatment performed on the first support means. The apertured nonwoven fabric may be produced by, after the fiber entangling treatment on the first support means, using, instead of the second support means, another second support means consisting of a smooth surfaced plate provided with a plurality of projections and drainage holes so that individual fibers of the fibrous web are deflected by water streams jetted from above the fibrous web aside towards zones of the surface defined by each pair of adjacent projections while entangling these individual fibers with each other.

5 Claims, 7 Drawing Sheets

FIG.13(a)
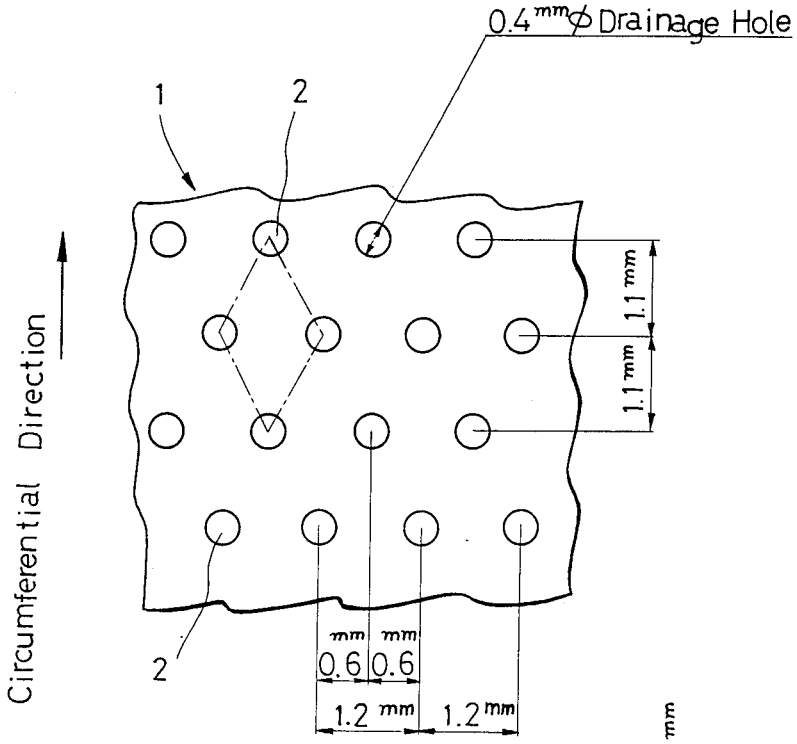
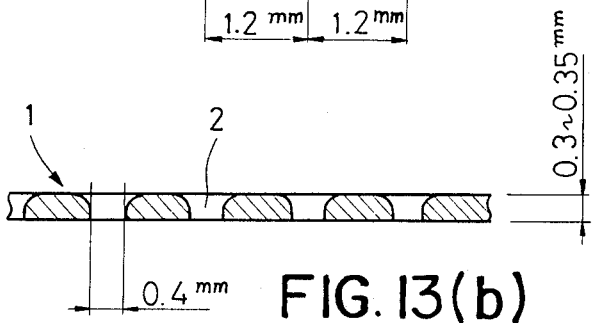
FIG. 13(b)

BACKING DRUM

This is a continuation of application Ser. No. 932,322, filed Nov. 19, 1986, now abandoned and the benefits of 35USC120 are claimed relative to it.

BACKGROUND

The present invention relates to a process and an apparatus for producing nonwoven fabric wherein fibrous web is introduced onto a support means and treated with high velocity water streams jetted from above the fibrous web so as to entangle individual fibers in the fibrous web with each other.

Conventional techniques for producing said nonwoven fabric include the following:

1. There have already been proposed a process and apparatus in which the fibrous web is introduced onto a travelling endless mesh screen and treated with high velocity water streams jetted through a plurality of fine orifices from above said fibrous web to achieve fiber entranglement. These are disclosed, for example, by U.S. Pat. No. 3,449,809.

2. Process and apparatus are also well known in which a fibrous web is introduced onto a travelling water impermeable endless belt, treated with high velocity water streams jetted through a plurality of fine orifices from above the fibrous web to achieve preliminary fiber entanglement, then said fibrous web is introduced onto a plurality of water impermeable rollers arranged downstream of said belt at predetermined intervals and on the respective rollers said fibrous web is treated with high velocity water streams jetted from above to achieve multistaged and full fiber entangling effect. These are disclosed, for example, in GB Patent No. 2,085,493B.

3. Process and apparatus have also been known in which the fibrous web is introduced onto support means comprising a combination of a travelling endless mesh screen and a water impermeable member having a narrower supporting surface in contact with the underside of said screen, treated with high velocity water streams jetted through a plurality of fine orifices from above said fibrous web while drainage is effected from the peripheral region of said member under suction so as to achieve a preliminary fiber entangling effect, then said fibrous web is introduced onto a plurality of water impermeable rollers arranged downstream of said screen at a predetermined interval, and, on the respective rollers, said fibrous web is treated again with high velocity water streams jetted through a plurality of fine orifices from above so as to accomplish multistaged and full fiber entangling effect. These are disclosed, for example, in EP Laid-Open Patent Application No. 0,147,904,A2.

According to said technique 1, to produce the nonwoven fabric, the fibrous web is supported on a relatively long continuous mesh screen including an aperture area ratio of 30 to 70% and treated with the water streams jetting on this mesh screen, so that the water streams which have completed their function are smoothly drained through said mesh and said fibrous web is practically free from the draft tending to disturb the fiber orientation. However, the water streams pass too smoothly through said screen to provide rebounding streams generated as a result of striking of the jetted water streams against said screen and fail to promote the desired fiber entanglement. As a consequence, the fiber entangling efficiency is poor and it is impossible to obtain a nonwoven fabric presenting high fiber entangling strength. Furthermore, the individual fibers of said fibrous web tend to twist around yarn crossing points constituting said screen under the action of the jetted water streams, so that some fibers are broken as said fibrous web is peeled off from said screen and remain on said screen, causing a problem of clogging. Such clogging becomes more serious as the water jetting pressure and the water delivery are increased in order to improve the fiber entangling efficiency and the fiber entangling strength. To obtain a nonwoven fabric of a high fiber entangling strength, not only the frequency at which said screen should be exchanged increases but also both said jetting pressure and said water delivery necessarily increase. Additionally, a low productivity is inevitable, resulting in a poor economical efficiency.

From an ideal point of view, said technique 2 is able to improve both the fiber entangling efficiency and the fiber entangling strength with respect to which said technique 1 is disadvantageous, since the jetted water streams do not pass said belt and it is possible for this technique 2 to adequately utilize the energy of the jetted water streams striking against said belt and the rebounding streams thereof for the desired fiber entangling effect. However, from a practical point of view since the water jetting is effected onto the starting fibrous web formed loosely and fluffily on said water impermeable belt, the fibers tend to float in the water streams remaining on said belt, and this results in disturbing the stability of the fiber entangling treatment. To avoid such inconvenience, the jetting pressure of the water streams must be reduced. When the jetting pressure has been thus reduced, the fiber entangling strength is unable to be adequately improved.

Therefore, said fibrous web will be subjected to an excessive draft exerted in the mechanical direction as said fibrous web is transported from one roller to the next roller during the following step and a fiber orientation is given in said direction and a disturbed fiber rearrangement is caused.

Said technique 3 aims to adequately utilize the energy of the jetted water streams striking against said water impermeable member and the rebounding streams thereof. However, another problem encountered by said technique 1, namely, the clogging of said screen can not be eliminated by said technique 3. Furthermore, the stability of fiber entangling treatment (for which said technique 2 is deficient) can be improved by technique 3 to some degree, but not enough to be satisfactory. In consequence, said fibrous web is subjected to an excessive draft exerted in the mechanical direction and given a fiber orientation in this direction as said fibrous web is transported, after being peeled off from said screen, from one roller to the next roller.

OBJECTS OF THE INVENTION

The present invention has as its principal object to provide a process and an apparatus for producing nonwoven fabric excellent in its fiber entangling strength and fiber rearrangement uniformity, by which the energy of the jetted water streams and the rebounding streams thereof are adequately utilized to improve the fiber entangling efficiency, and which eliminates the difficulty in peeling off of the fibrous web from the support means due to twisting of fibers around the yarn crossing points when the screen including such yarn crossing points is used as said support means and effectively avoid the fiber orientation in the mechanical direction usually developed in the fibrous web as said fibrous web is transported.

A further object of the present invention is to provide a process and an apparatus for producing non-apertured nonwoven fabric of said excellent characteristics in which the fiber entangling treatment is completed in a single step using first support means consisting of a smooth surface plate including a plurality of drainage holes distrubuted thereon.

Another object of the present invention is to provide a process and an apparatus for producing non-apertured nonwoven fabric of said excellent characteristics in which the fibrous web is subjected to the fiber entangling treatment performed on said first support means and then the fibrous web having thus acquired said fiber entanglement is subjected to the fiber entangling treatment on smooth surfaced water impermeable second support means arranged at predetermined intervals in the travelling direction of said fibrous web.

Still another object of the present invention is to provide a process and an apparatus for producing apertured nonwoven fabric of said excellent characteristics in which, after the fiber entangling treatment on said first support means, the fibrous web is subjected again to the fiber entangling treatment on, instead of said second support means, another second support means consisting of a smooth surfaced plate including a plurality of projections and drainage holes regularly distributed thereon so as to achieve aperture formation simultaneously.

BRIEF DESCRIPTION OF THE DRAWING

FIG. 13*a* shows said first support means in a partial developed plan view and FIG. 13*b* is a sectional view of FIG. 13 *a;*

PREFERRED EMBODIMENTS OF THE INVENTION

Figure 1:
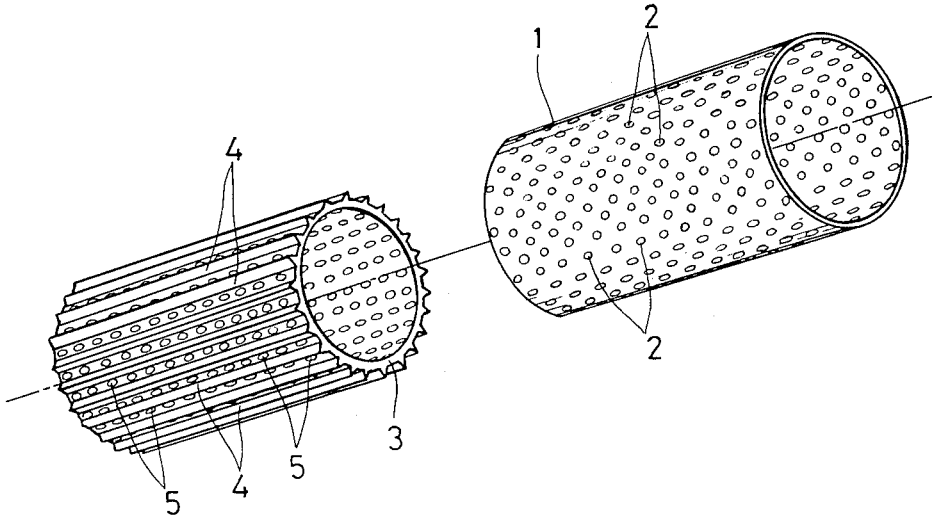
FIG. 1 is a perspective view separately showing a cylinder having drainage holes and a roller adapted to support said cylinder and having drainage holes, constituting together first support means according to the present invention.
Figure 2:
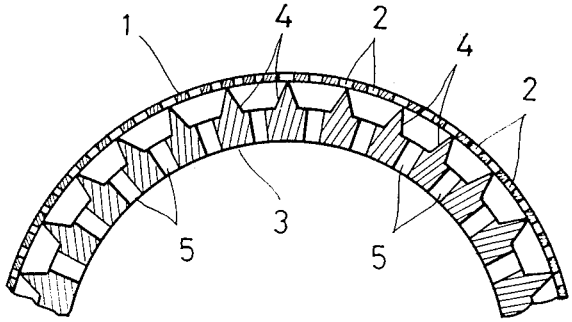
FIG. 2 is a partial cross section showing said two components as assembled together.

In FIGS. 1 and 2, support means 1 is illustrated. The support means 1 comprises a smooth surfaced plate formed in a cylinder of given diameter and length, and provided with a plurality of independent drainage holes 2 arranged at predetermined intervals. Preferably, each set of four adjacent drainage holes 2 are disposed in a diamond pattern in the circumferential direction of the cylinder (in which fibrous web as will be described travels) so that individual fibers of the fibrous web may be rearranged more or less at random as said fibrous web supported on the support means travels. Preferably, each of said drainage holes 2 has a diameter of 0.2 to 1.0 mm and the drainage holes 2 as a whole occupy 2.5 to 30% of the effective area on the support means 1. With a diameter smaller than 0.2 mm, said holes would often be clogged with impurities or foreign substances included in the fibrous web and the water streams, resulting in a low drainage efficiency and with a diameter larger than 1.0 mm, the fibers of said fibrous web would cohere in said holes or pass through said holes under the pressure of jetted water streams, resulting in a disturbed fiber rearrangement of said fibrous web and formation of undesirable apertures in the finished nonwoven fabric. When the area ratio of the drainage holes is less than 2.5%, drainage would be ineffective and, when the area ratio is higher than 30%, the plate surface of the support means 1 against which the jetted water streams strike and generate rebounding streams would be reduced and the mechanical strength of the support means 1 would be also reduced.

The support means 1 is supported by a supporting roller 3 provided therearound with a plurality of axially extending ridges 4 triangular in their cross sections and arranged circumferentially at predetermined intervals and a plurality of drainage holes 5 arranged at predetermined intervals in an axial direction between each pair of adjacent ridges 4. The supporting roller 3 is fixedly inserted into said support means 1 so that tips of the respective ridges 4 are in contact with the inner surface of the support means 1. There is provided suction means for drainage (not shown) within said supporting roller 3.

The support means 1 is made from a metallic plate or sheet having a surfficient hardness to generate the rebounding streams when jetted water streams strike thereagainst and thereby to permit these rebounding streams to contribute to promotion of fiber entanglement. Although it is preferred to form the support means 1 in the form of a cylinder as shown, it is also possible to form this support means 1 in the form of a travelling endless belt or a semi-spherically curved stationary plate.

Figure 3:
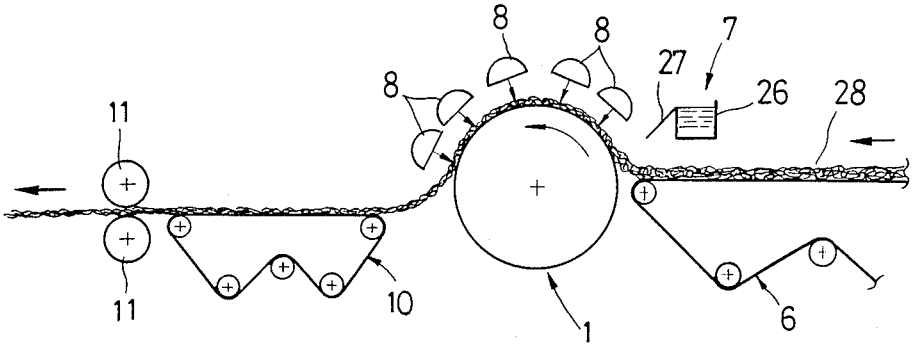
FIG. 3 is a side view schematically showing an apparatus of the present invention incorporated with said first support means.

In FIGS. 3 though 5, an embodiment of the apparatus according to the present invention is shown, in which the support means 1 is disposed.

The apparatus shown by FIG. 3 comprises the support means 1, a belt conveyor 6, water screen delivery means 7, respective jetting means 8 arranged at predetermined intervals circumferentially of said support means 1 and directed there against another belt conveyor 10 and a pair of squeeze rollers 11.

Figure 4:
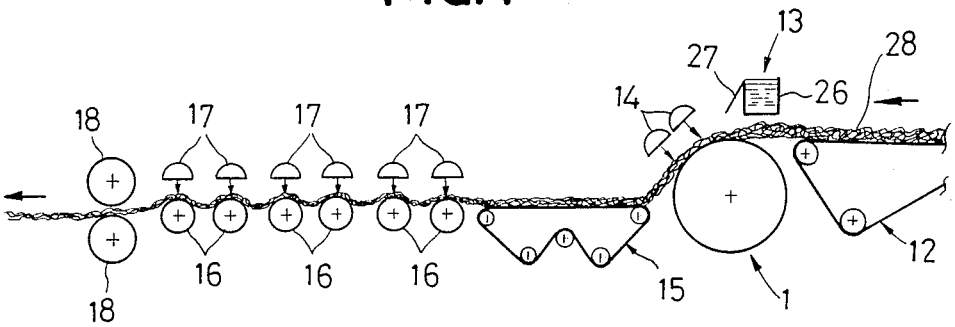
FIG. 4 is a side view schematically showing the apparatus of the present invention incorporated with said first support means and second support means consisting of water impermeable rollers.

The apparatus shown by FIG. 4 comprises the support means 1, a belt conveyor 12, water screen delivery means 13, respective jetting means 14 disposed above said support means 1 and directed there against another belt conveyor 15, respective water impermeable supporting rollers 16 disposed downstream of said support means 1 at predetermined intervals in the machine direction, respective jetting means 17 disposed above said respective supporting rollers 16 and directed thereagainst and a pair of squeeze rollers 18.

Figure 5:
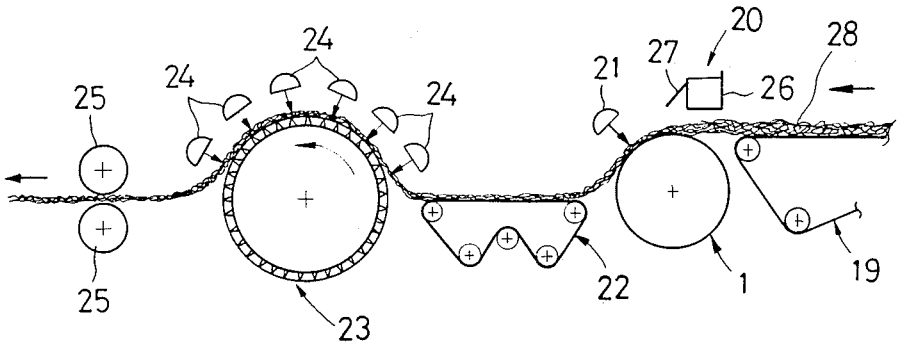
FIG. 5 is a side view schematically showing the apparatus of the present invention incorporated with another second support means consisting of a cylinder provided with projections and drainage holes.

The apparatus shown by FIG. 5 comprises the support means 1, a belt conveyor 19, water screen delivery means 20, jetting means 21 disposed above said support means 1 and directed thereagainst, another belt conveyor 22, another support means 23 disposed downstream of said support means 1, respective jetting means 24 arranged above said support means 23 at predetermined intervals circumferentially of said support means 23 and directed thereagainst, and a pair of squeeze rollers 25.

The water screen delivery means 7, 13, 20 are so constructed that a constant amount of water stream continuously overflows from a reservoir 26 downwards along an inclined plate 27 onto fibrous web 28. In this manner, it is possible to achieve fiber entangling treatment of the fibrous web 28 without raising a nap thereon and in a stabilized condition.

The respective jetting means 8, 14, 17, 21, 24 include a plurality of fine orifices arranged transversely at a predetermined pitch and are arranged transversely of the fibrous web 28.

The respective supporting rollers 16 are made of metal or the like having a sufficient hardness to generate rebounding water streams contributing to promote fiber entanglement when the jetted water streams strike thereagainst. It should be understood that these supporting rollers 16 may be curved plates or flat plates having relatively small supporting surfaces.

Figure 6:
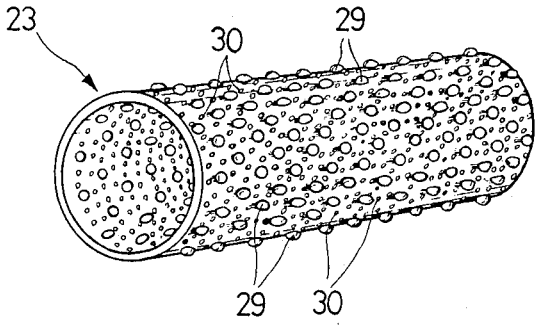
FIG. 6 is a perspective view showing said another second support means.
Figure 7:
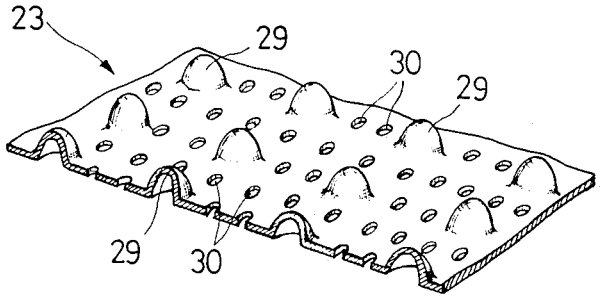
FIG. 7 is a partial developed perspective view of said second support means as shown by FIG. 6.
Figure 8:
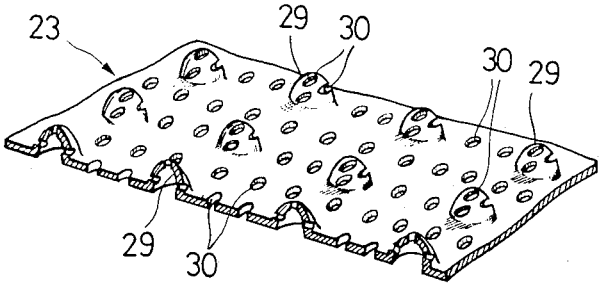
FIG. 8 is a partial developed perspective view of still another embodiment of said second support means.
Figure 9:
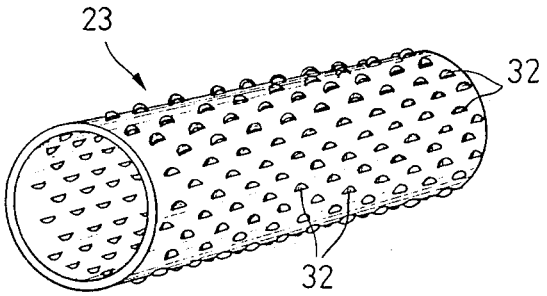
FIG. 9 is a perspective view showing a further another embodiment of said second support means.
Figure 10:
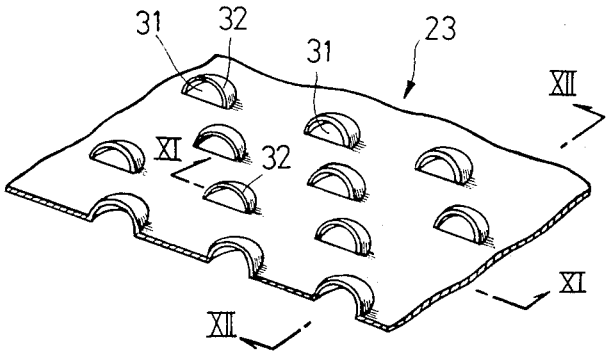
FIG. 10 is a partial developed perspective view of said second support means as shown by FIG. 9.
Figure 11:
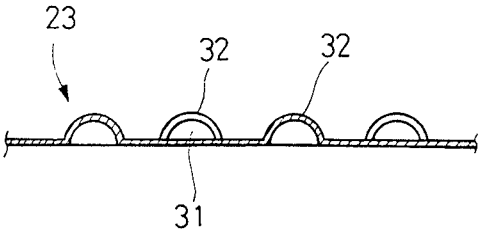
FIG. 11 is a sectional view taken along a line XI—XI in FIG. 10.
Figure 12:
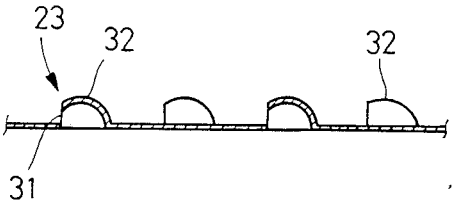
FIG. 12 is a sectional view taken along a line XII—XII in FIG. 10.

The support means 23 may also be is configured as shown in FIGS. 6 through 8. The support means 23 is in the form of a cylinder having the desired diameter and length. The support means 23 comprises a plurality of projections 29 carried at a predetermined pitch on a smooth surface of the body thereof and a plurality of drainage holes 30 formed in a regular array in zones of the surface defined between each pair of adjacent said projections. Each of the projections 29 preferably has a shape which gradually diverges from its apex towards its base, such as a semi-sphere, in order to improve the efficiency at which apertures are formed in the fibrous web 28 and to facilitate peeling off of the nonwoven fabric from the support means 23. To form clearly defined apertures in the nonwoven fabric, it is preferred that each of the projections 29 has a diameter of 0.3 to 15 mm and a height of 0.4 to 10 mm. The projections 29 are preferably arranged at a pitch of 1 to 15 mm. In the embodiment shown by FIG. 7, the drainage holes 30 are carried, in the zones defined between the projections 29 and such an arrangement is optimal for fiber distribution as well as for aperture formation. However, it is possible to form these drainage holes 30 also in the respective projections 29 as in the embodiment shown by FIG. 8. The drainage holes 30 preferably have a diameter of 0.2 to 2.0 mm and total area thereof preferably occupy 2 to 35% of the effective surface area of the support means 23 for the same reason as the has been described above in relation to the diameter of the drainage holes 2 and the area ratio thereof in said support means 1. However, the fibers in the fibrous web have been preliminarily entangled to some degree, so that the maximum diameter of the drainage holes 30 can be 2.0 mm larger than the maximum diameter 1.0 mm of the drainage holes 2 in said support means 1.

In the optimal embodiment, the support means 23 is in the form of a cylinder having the desired diameter and length as well as the desired hardness as in the case of said support means 1. However, it is also possible to realize the support means 23 as a travelling endless belt or even as a stationary semi-spherically curved plate. There is provided suction means for drainage (not shown) within the support means 23.

The support means 23 may be also configured as shown by FIGS. 9 through 12. The support means 23 in such an embodiment comprises a plurality of projections 32 carried at a predetermined pitch on a smooth surface of the body thereof and respectively having drainage holes 31 on one side. To improve the an efficiency at which apertures are formed in the fibrous web 28 and to facilitate peeling off of the nonwoven fabric from the support means 23, each of the projections 32 preferably has a shape gradually diverging from its apex towards its base, such as a dome. Each of the drainage holes 31 opens at a predetermined angle with respect to the smooth surface of the support means 23 so that the fibers of the fibrous web do not enter thereinto when the high velocity water streams are jetted from above onto the fibrous web supported on the support means 23. The optimum opening angle is substantially normal (90°) to the plate surface and 75° to 105° falls within a tolerable range.

Other conditions concerning the drainage holes 31 and the projections 32 are same as those concerning said drainage holes 30 and said projections 29.

The projections 29, 32 are preferably disposed, as in the case of said drainage holes 2 shown in FIG. 13, in diamond patterns as viewed in circumferential direction of the support means 23 or in the travelling direction of said fibrous web 28 in order to obtain apertured nonwoven fabric presenting a high tensile strength.

In the embodiment shown by FIG. 3, the fibrous web 28 is introduced onto the support means 1 and treated with the water streams jetted from the orifices of the respective jetting means 8 while drainage is effected by the suction means (not shown) disposed within said support means 1 so as to entangle fibers at random and thereby to produce non-apertured nonwoven fabric.

In the embodiment shown by FIG. 4, the fibrous web 28 is introduced onto the support means 1, treated with the water streams jetted from the orifices of the means 14 while drainage is effected by the suction means (not shown) disposed within the support means 1 for preliminary fiber entangling at random, then the fibrous web 28 is introduced onto the respective supporting rollers 16 and, on the respective rollers, treated with the water streams jetted from the orifices of the respective jetting means 17 so as to achieve full fiber entanglement and thereby to produce non-apertured nonwoven fabric.

In the embodiment shown by FIG. 5, the fibrous web 28 is introduced onto the support means 1, treated with the water streams jetted from the orifices of the respective jetting means 21 while drainage is effected by the suction means (not shown) disposed within said support means 1 for preliminary fiber entangling at random, then the fibrous web 28 is introduced onto the support means 23 and further treated with the water streams jetted from the orifices of the respective jetting means 24 so as to deflect the fibers aside towards the zones of the surface defined between the projections 29 or 32 while drainage is effected by the suction means (not shown) disposed within said support means, and thereby to form apertures and simultaneously to achieve full fiber entanglement, thus producing apertured nonwoven fabric. Said apertures are clearly formed, since the individual fibers of the fibrous web 28 are deflected by the water streams jetted from the orifices of the respective jetting means 24 aside towards the zones of the surface defined between the projections 29 or 32 as shown in FIGS. 6 through 12. In consequence, the nonwoven fabric thus produced is given a clear pattern of apertures corresponding to the arrangement of said projections.

It should be noted here that the support means 23 is shown as an example of that for producing apertured nonwoven fabric, and a mesh screen having a plurality of projections may be used as such support means, provided the fibrous web 28 has been fiber-entangled through said support means 1 to some degree.

A jetting pressure of the water streams is preferably in order of 20 to 100 kg/cm$^2$. At the jetting pressure lower than 20 kg/cm$^2$, sufficient energy to entangle the fibers could not be obtained and both the fiber entangling efficiency and the entangling strength would be inadequate. At the jetting pressure higher than 100 kg/cm$^2$, the manufacturing cost would increase and lead to commercial disadvantages. Concerning the water delivery quantity, a range of 0.5 to 20 l/m$^2$ is preferable and the water delivery lower than 0.5 l/m$^2$ could not achieve satisfactory fiber entangling efficiency and the entangling strength as in the above mentioned case of the jetting pressure. The water delivery depends on the jetting pressure as well as the diameter and the number of orifices arranged in the respective jetting means. With a water delivery higher than 20 l/m$^2$, however, both the fiber entangling efficiency and the entangling strength could not be proportionally improved, resulting in an economical disadvantage.

The fibrous web may be any type of fibers well known for producing nonwoven fabric. The fibrous web configuration also may be parallel or random and it is preferred to use that having its basic weight less than 150 g/m$^2$, especially 100 g/m$^2$.

It should be noted here that the wording "plate" in connection with the support means 1, 23 means that these support means are neither woven nor knitted bodies but comprise plate or sheet, or layer of relatively small thickness, no matter whether they are curved or planar.

As obviously understood from the aforegoing description, the process and the apparatus according to the present invention is advantageous in that the water impermeable or non-apertured support means is employed for adequate utilization of the energy of the jetted water streams and the rebounding streams thereof generated as the jetted water streams strike against said support means to entangle the fibers with each other, and the problem encountered by utilization of said water impermeable or non-apertured support means, namely, the problem that the fiber entangling efficiency as well as the fiber entangling strength can not be improved since both the jetting pressure and the water delivery are restricted by the insufficient drainage, can be effectively resolved. Furthermore, the process and the apparatus according to the present invention can effectively overcome the problem encountered by use of the mesh screen as the support means, namely, the problem that the fibers tend to twist around the yarn crossing points constituting the mesh screen and, as result, the fibrous web (nonwoven fabric) is subjected to an excessive draft when said fibrous web (nonwoven fabric) is peeled off from said support means, causing a fiber orientation in the mechanical direction and a disturbed fiber rearrangement, and, in addition, the support means must be often exchanged because of clogging of the support means with broken fibers. Moreover, in producing the apertured nonwoven fabric, according to the apertured support means as shown in the embodiment of the present invention, the fibers are deflected aside by the aforementioned unique projections and thereby clearly defined apertures can be formed. According to the process and the apparatus of the present invention, thus, the objects as previously set forth are achieved and a nonwoven fabric of excellent characteristics can be produced at a rational cost.

EXAMPLE 1

Figure 14:
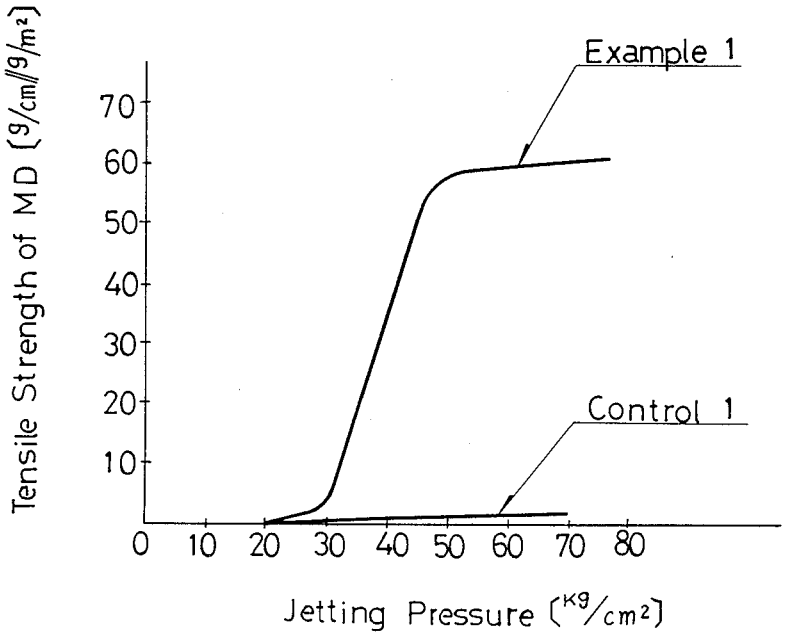
FIG. 14 is a graphic diagram illustrating a relationship between MD tensile strength and jetting pressure in Example 1 and Control 1.

Polyester fibrous web of 1.4 d×44 mm staple length was introduced onto the apertured support means as shown by FIG. 1, which is used for the apparatus as shown by FIG. 3, and treated with high speed water streams jetted from above while drainage was effected under suction from below. Thus, substantially non-apertured (non-patterned) nonwoven fabric was obtained with a basic weight of 30 g/m$^2$. A tensile strength of the nonwoven fabric thus obtained with a water delivery to said fibrous web of 1 l/m$^2$ and a jetting pressure varying, and a relationship between a jetting pressure and a MD tensile strength is shown by FIG. 14.

Said support means had the following specification:

Material: nickel plate

Area ratio of drainage holes (total area of drainage holes/effective total area of support means): 9.5%

Dimensions: as shown in FIG. 13.

CONTROL 1

Substantially non-apertured (non-patterned) nonwoven fabric was obtained with a basic weight of 30 g/m$^2$ in the similar manner as in Example 1 except that a polyester mesh screen (76 meshes in satin weave) was utilized as the support means. The determination was made in the same manner as in Example 1 and the results were obtained as shown in FIG. 14.

EXAMPLE 2 AND CONTROL 2

Figure 15:
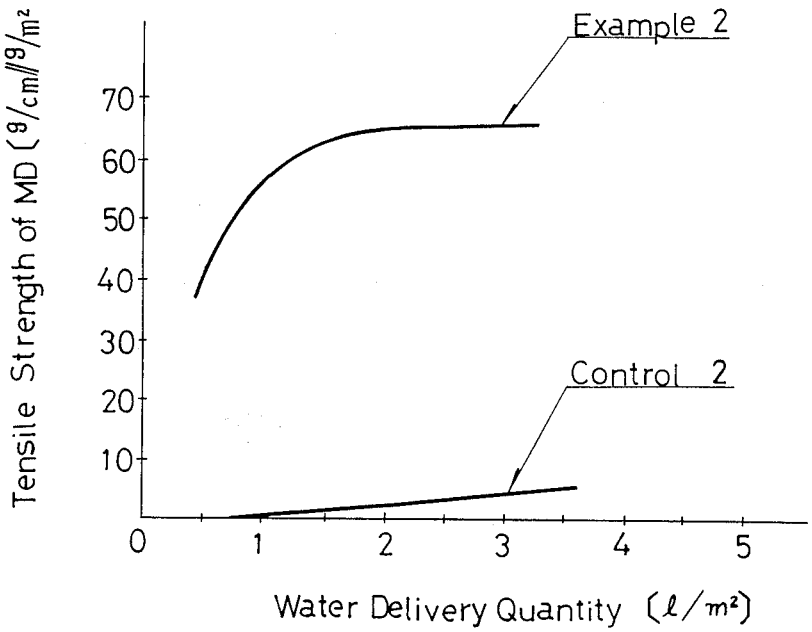
FIG. 15 is a graphic diagram illustrating a relationship between MD tensile strength and water delivery in Example 2 and Control 2.

Substantially non-apertured (non-patterned) nonwoven fabrics were obtained with a fixed jetting pressure of 50 kg/cm$^2$ but under the same conditions as in Example 1 and Control 1, respectively. A relationship between a water delivery to the nonwoven fabric of 1 l/m$^2$ and a MD tensile strength was determined and the results were obtained as shown in FIG. 15.

EVALUATION OF EXAMPLES 1, 2 AND CONTROLS 1, 2

Example 1 and 2 provide fiber entangling efficiencies relative to the water delivery and the jetting pressure substantially higher than that as has conventionally been achieved by using the support means consisting of mesh screen. Accordingly, it is possible for the technique according to Examples 1 and 2 to provide the nonwoven fabrics similar in their tensile strengths to that as has been provided by the well known technique utilizing the mesh screen as the support means, with a smaller water delivery and a lower jetting pressure. This is significantly advantageous both in view of running cost and equipment cost. In other words, a product which is improved in its strength characteristic can be achieved by the technique as employed by Examples 1 and 2 at the same cost as required for the conventional techinque.

EXAMPLE 3

1.4 d×44 mm staple lengths polyester fibrous web with a basic weight of 30 g/m$^2$ was introduced onto the apertured support (apertured area ratio of 9.5%) as shown by FIG. 1 and used in the apparatus as illustrated in FIG. 4 and treated with high velocity water streams jetted from above at a pressure of 50 kg/cm$^2$ while drainage was effected under suction from below said support. Thus, a fiber entangled web was obtained, which presented a MD tensile strength of 20 g/cm//g/m$^2$ allowing a treatment by high velocity water streams on the water impermeable roller. An amount of treatment water necessary therefor was 1.5 l/m$^2$.

Then said fibrous web was twice treated with high speed water streams at a pressure of 50 kg/cm$^2$ on a water impermeable roller of stainless steel having a diameter of 140 mm and substantially non-apertured (non-patterened) nonwoven fabric was obtained, which presented a MD tensile strength of 83 g/cm//g/m$^2$ and a uniform fiber rearrangement.

A total amount of treatment water was 5.8 l per 1 m$^2$ of said fibrous web (nonwoven fabric).

Figure 16:
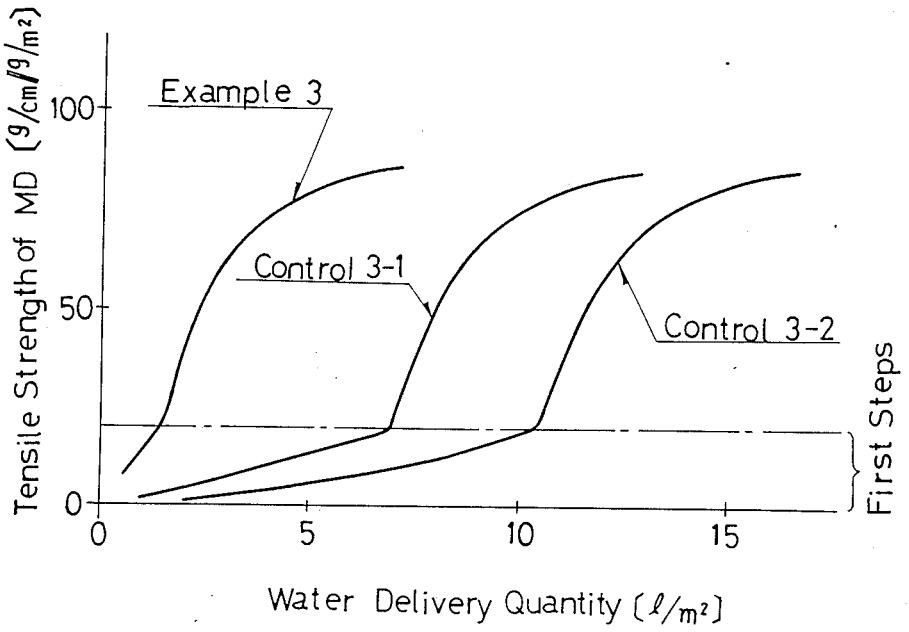
FIG. 16 is a graphic diagram illustrating a relationship between MD tensile strength and water delivery in Example 3 and Controls 3 - 1, 3 - 2.

A relationship between a MD tensile strength of the nonwoven fabric thus obtained and an amount of treatment water is shown in FIG. 16.

CONTROL 3 - 1

A fibrous web in Example 3 was introduced onto a polyester mesh screen (76 meshes) and treated three times with high velocity water streams at a pressure of 50 kg/cm$^2$. As a result, a fiber entangled web presenting a MD tensile strength of 20 g/cm//g/m$^2$ was obtained. The amount of treatment water necessary therefor was 7 l per 1 m$^2$ of said fibrous web.

Such fibrous web was further treated in the same manner as Example 3 and substantially non-apertured (non-patterned) nonwoven fabric having approximately the same MD tensile strength was obtained.

The total amount of treatment water was 11.4 l per 1 m$^2$ of said fibrous web (nonwoven fabric).

The relationship between the tensile strength of the nonwoven fabric thus obtained and the amount of treatment water is shown in FIG. 16.

CONTROL 3 - 2

A fibrous web as in Example 3 was introduced onto a polyester mesh screen (76 meshes), then treated five times with high velocity water streams at a pressure of 30 kg/cm$^2$ and a fiber entangled web having a MD tensile strength of 20 g/cm//g/m$^2$ was obtained. The amount of treatment water necessary therefor was 10.5 l per 1 m$^2$ of said fibrous web.

The said fibrous web was then further treated in the same manner as in Example 3 and substantially non-apertrured (non-patterned) nonwoven fabric presenting approximately the same MD tensile strength was obtained.

The total amount of treatment water was 15 l per 1 m$^2$ of said fibrous web (nonwoven fabric).

The relationship between the tensile strength of the nonwoven fabric thus obtained and the amount of treatment water is shown in FIG. 16.

EVALUATION OF EXAMPLE 3 AND CONTROLS 3 - 1, 3 - 2

When fibers of the fibrous web are entangled on the apertured support plate and then fiber entanglement is effected again on the water impermeable roller serving as a separate support, the present invention provides a fiber entangling efficiency higher is achieved by the conventional technique in which fibers of a fibrous web are entangled on a mesh screen and then fiber entanglement is effected again on a water impermeable roller as the separate support. The present invention is advantageous insofar as both strength characteristics as well as manufacturing cost are concerned.

EXAMPLE 4

A polyester fibrous web of 1.4 d×44 mm staple length was introduced onto the apertured support (apertured area ratio 9.5%) as shown b FIG. 1 and employed in the apparatus as illustrated in FIG. 5, treated with high velocity water streams jetted from above at a pressure of 30 kg/cm$^2$ while drainage was effected under suction from below said support. A substantially non-apertured (non-patterned) fiber entangled web was obtained with a basic weight of 30 g/m$^2$. This fibrous web presented a MD tensile strength of 20 g/cm//g/m$^2$.

This fibrous web was then introduced onto a support means including apertures and the projections as shown by FIG. 6, treated with high velocity water streams jetted from above at a pressure of 70 kg/cm$^2$ while drainage was effected under suction from below said support and an apertured nonwoven, fabric was obtained. The water delivery necessary for this result was 7.5l/m$^2$.

Figure 17:
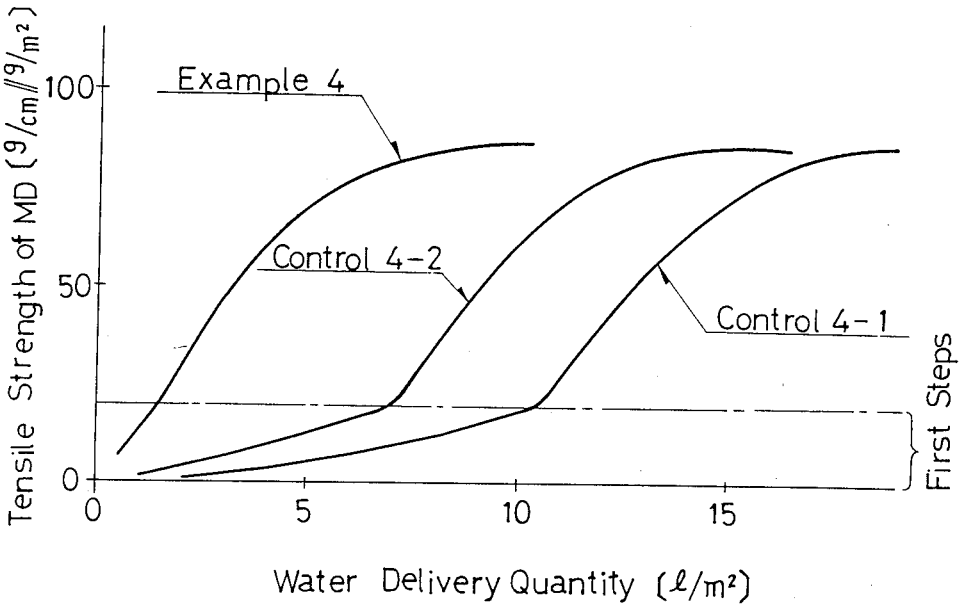
FIG. 17 is a graphic diagram illustrating a relationship between MD tensile strength and water delivery in Example 4 0611 and Controls 4 - 1, 4 - 2.

The relationship between a MD tensile strength of the nonwoven fabric thus obtained and the amount of treatment water is shown in FIG. 17.

CONTROL 4 - 1

A fiber entangled web was obtained after the same treatment as the preliminary treatment in Example 4 except that the apertured support means as shown by FIG. 1 was replaced by plastic wire mesh screen (70 mesh).

Subsequently, said fibrous web was treated on the support means including the projections and the apertures as shown by FIG. 6 which was employed in Example 4 and apertured nonwoven fabric was obtained.

The relationship between the MD tensile strength of the nonwoven fabric thus obtained and the amount of treatment water is shown in FIG. 17.

CONTROL 4 - 2

A treatment was carried out in the same manner as in Control 4 - 1 except that the high velocity water streams were jetted at a pressure of 50 kg/cm$^2$.

The relationship between a MD tensile strength of the nonwoven fabric thus obtained and an amount of treatment water is shown in FIG. 17.

EVALUATION OF EXAMPLE 4 AND CONTROLS 4 - 1, 4 - 2

To achieve aperture formation in the fibrous web, said fibrous web must be given a MD tensile strength of approximately 20 g/cm//g/m$^2$ during the preliminary fiber entangling treatment. To satisfy this requirement, approximately 2 l/m$^2$ of water is jetted from a single row of nozzles at a pressure of 30 kg/cm$^2$ in Example 4. In contrast with this, 10.5 l/m$^2$ of water must be jetted from three rows of nozzles at the same pressure in Control 4 - 1 and 7 l/m$^2$ of water must be jetted from three rows of nozzles at a pressure of 50 kg/cm$^2$ in Control 4 - 2. Furthermore, it was found that, in Control 4 - 2, there is a problem in exfoliation of the fibrous web from the supporting mesh.

What we claim is:

1. A drum arrangement useful for converting a fibrous material into a water-entangled fiber mass comprising in combination:

(A) an elongated cylindrical backing roll (1) which is adapted to directly support said fibrous layer, said cylindrical backing roll (1) consisting of an elongated unitary smooth-surfaced metallic cylinder that has a plurality of water drainage holes (2) regularly distributed over its surface, each hole (2) having a diameter of 0.2 to 1.0 mm and the total area occupied by said plurality of holes being 2.5–30% relative to the total effective surface area of said metallic cylinder, and (B) an elongated unitary cylindrical supporting roll (3)

(a) that is telescoped within the interior of said cylindrical backing roll (1) so that the portions of exterior of said cylindrical supporting roll (3) abut against the interior of said cylindrical backing roll (1) in a supporting relationship, (b) that includes a plurality of elongated upstanding ridges (4) disposed around its circumference at spaced apart intervals, said elongated ridges (4) being both parallel to each other and parallel to the axis of said elongated cylindrical supporting roll (3), and (c) that includes a plurality of elongated troughs formed between adjacent elongated ridges (4), each elongated trough containing an elongated row of water drainage holes (5) which permit water that has passed through said holes (2) in said backing roll (1) to pass through said supporting roll (3).

2. An arrangement according to claim 1 wherein each set of four adjacent drainage holes (2) is disposed in the form of a diamond pattern

3. An arrangement according to claim 1 wherein said ridges (4) are triangular in cross section with the apex of the triangles abutting the interior surface of said supporting roll (1).

4. An arrangement according to claim 1 wherein said backing roll (1) contains a plurality of upstanding projections (29) positioned between adjacent drainage holes (2), said projections (29) having the shape of semi-spheres (29), with the base of each semi-sphere (29) being joined to the exterior surface of said backing roll (1).

5. An arrangement according to claim 4 wherein said semi-spheres (29) also contain drainage holes (30).

* * * * *